US006651637B1

(12) United States Patent
Morrissette et al.

(10) Patent No.: US 6,651,637 B1
(45) Date of Patent: Nov. 25, 2003

(54) VEHICLE IGNITION SYSTEM USING IGNITION MODULE WITH REDUCED HEAT GENERATION

(75) Inventors: Gary E. Morrissette, Orlando, FL (US); Reginald L. Browning, Orlando, FL (US)

(73) Assignee: Transpo Electronics, Inc., Orlando, FL (US)

( * ) Notice: Subject to any disclaimer, the term of this patent is extended or adjusted under 35 U.S.C. 154(b) by 0 days.

(21) Appl. No.: 10/283,015

(22) Filed: Oct. 29, 2002

(51) Int. Cl.[7] ..... F02P 9/00
(52) U.S. Cl. ..... 123/609; 123/630; 123/594
(58) Field of Search ..... 123/609, 630, 123/623, 594, 612

(56) References Cited

U.S. PATENT DOCUMENTS 4,128,091 A * 12/1978 Balan et al. ..... 123/611
4,638,785 A * 1/1987 Matsui et al. ..... 123/406.66
5,014,676 A 5/1991 Boyer ..... 123/637
5,298,851 A 3/1994 DeNardis ..... 322/28
5,635,841 A 6/1997 Taylor ..... 324/380
6,178,957 B1 1/2001 Widiger et al. ..... 123/634

* cited by examiner

*Primary Examiner*—Bibhu Mohanty
(74) *Attorney, Agent, or Firm*—Allen, Dyer, Doppelt, Milbrath & Gilchrist, P.A.

(57) ABSTRACT

An ignition system for a vehicle includes a distributor having with a Hall Effect stator assembly and ignition module formed preferably as a thick film integrated (TFI) module, which receives a spark output (SPOUT) signal from an electronic control assembly (ECA). The ignition module includes a microprocessor for generating a control signal to an ignition coil and switching ON and OFF the primary current therein. A temperature sensing circuit is operative with the microprocessor for reducing the duty cycle or overall current or power as applied to the control signal from the TFI ignition module to the ignition coil and reducing the heat generated by the. TFI ignition module when a temperature threshold for the TFI ignition module has been exceeded.

28 Claims, 4 Drawing Sheets

VEHICLE IGNITION SYSTEM USING IGNITION MODULE WITH REDUCED HEAT GENERATION

FIELD OF THE INVENTION

This invention relates to the field of ignition systems for vehicles, and more particularly, this invention relates to ignition systems for vehicles using an electronic control assembly (ECA), a distributor, and ignition module that switches ON and OFF the primary current to the ignition coil.

BACKGROUND OF the INVENTION

Electrical ignition systems are used in most automotive vehicles to create a high-voltage current (about 20,000 to about 40,000 volts or more) to a sparkplug and create an arc across the gap at the base of the sparkplug. This high-voltage current creates a strong spark that ignites the air/fuel mixture for combustion. The ignition system also controls the spark timing such that the spark occurs at the right time and in the correct cylinder. Although many different automotive ignition systems have developed over the last century, most ignition systems only differ in the method or system used to create the spark.

In the original electrical ignition systems, a mechanical system used simple breaker points as a switching mechanism to control a current flow through an ignition coil containing the primary and secondary winding circuits. Usually the primary winding of the ignition coil contains about 100 to about 150 turns of heavy and insulated copper wire. The insulation insulates the turns and prevents electrical shorts. A secondary coil winding contains about 15,000 to about 30,000 or more turns of fine copper wire, also insulated, and typically wound around a soft iron core. Usually oil is used for cooling the coil and it provides a medium to protect the coil from the excessive heat generated by large current flows. Other cooling mechanisms can also be used. As current flows through the primary coil, a magnetic field is established. When the breaker points are opened, the current is shut off and the collapsing magnetic field induces a high voltage in the secondary winding that is released through a center coil tower to a rotor, which distributes spark through a distributor cap and high tension sparkplug wires to the proper sparkplug.

Automotive electrical ignition systems have advanced over the years from simple vacuum advance mechanical systems to electronic systems. Modern ignition systems use distributorless (electronic) ignition systems (EIS) that replace prior mechanical and simple electronic ignition systems with computer-controlled spark advance. In a distributorless ignition system(DIS), a crankshaft timing sensor triggers the ignition system, which typically includes a Hall Effect magnetic switch activated by vanes on a crankshaft damper and pulley assembly. A signal is generated corresponding to vehicle engine timing and RPM and transmitted to the distributorless ignition system (DIS) and a microprocessor that is part of a distributorless ignition system (DIS) electronic control assembly or module. A camshaft sensor can provide information on cylinder position for the ignition coil and fuel system. The distributorless ignition system (DIS) electronic engine assembly receives a signal from the crankshaft sensor and camshaft sensor and a spark signal from a computer of the vehicle to control the ignition coils, allowing them to fire in the correct sequence. The DIS electronic control assembly can also control engine dwell.

An ignition coil pack can use multiple ignition coils and the DIS electronic control assembly controls the coils.

The DIS ignition system and similar circuit components are commonly used on most modern automotive vehicles. Millions of earlier designed electronic ignition systems (EIS), however, are still used on earlier vehicle models and are still operable, although many are now failing. These earlier electronic ignition systems still use a computer-controlled spark advance system and ignition coil having the primary and secondary windings. An electronic control assembly (ECA) receives many sensor inputs and generates a spark output (SPOUT) signal. The distributor has a typical multipoint or similarly designed rotor or armature, shaft assembly and a Hall Effect stator assembly mounted in the distributor that generates a profile ignition pickup (PIP) signal to the electronic control assembly (ECA) indicative of crankshaft position and engine RPM. An ignition module is formed as a thick film integrated (TFI) module and has an integrated circuit within a module housing that is usually mounted on the distributor base. It receives the spark output (SPOUT) signal from the electronic control assembly (ECA). The TFI module generates a control signal to the ignition coil and switches ON and OFF the primary current therein, typically using an insulated gate field effect transistor (IGFET) or similar switching device.

A major drawback of these prior art thick film integrated (TFI) modules and similar ignition modules is the excessive production of generated heat resulting from the large duty cycle and constant ON operation when the TFI module generates signals to the ignition coil to fire the spark at proper timing intervals. Although the TFI module usually includes a heat sink to aid in absorbing excessive amounts of generated heat at low idle speeds and other automotive operations conditions, excessive heat is still generated, at the TFI module and ignition coil, possibly resulting in logic errors, signal transmission errors, and other automotive problems.

SUMMARY OF THE INVENTION

It is therefore an object of the present invention to provide an ignition system for vehicles having an ignition coil, electronic control assembly (ECA) and ignition module, such as a thick film integrated (TFI) module, and having reduced heat generation, especially at idle and low RPM speeds.

The present invention advantageously incorporates a microprocessor within the ignition module for generating a control signal to an ignition coil and switching ON and OFF the primary current therein. A temperature sensing circuit is operative with the microprocessor such that the duty cycle or overall output current as applied to the control signal from the ignition module to the ignition coil is reduced for reducing the heat when a temperature threshold for the ignition module has been exceeded.

In accordance with the present invention, an ignition system for a vehicle includes an ignition coil having primary and secondary windings for generating high-voltage signals to sparkplugs. An electronic control assembly (ECA) generates a spark output (SPOUT) signal. A distributor includes a Hall Effect stator assembly mounted therein that generates a profile ignition pickup (PIP) signal indicative of crankshaft position and engine RPM to the electronic control assembly (ECA). The ignition module as a preferred thick film integrated (TFI) module receives the spark output (SPOUT) signal from the electronic control assembly (ECA). The ignition module includes a microprocessor for generating a control signal to an ignition coil and switching ON and OFF the primary current therein. A temperature sensing circuit is operative with the microprocessor for reducing the duty cycle or overall output current or power as applied to the control signal from the ignition module to reduce the generated heat when a temperature threshold for the ignition module has been exceeded.

In yet another aspect of the present invention, the distributor base has mounted therein an armature and shaft assembly. The ignition module is mounted on the distributor. A thick film substrate in the module comprises an integrated circuit and includes a microprocessor that is operative for reducing the duty cycle or overall or average output current or power from about 5% to about 15%. A temperature sensing circuit typically includes a temperature sensing resistor and reference diode. The ignition module also includes a voltage reduction circuit for reducing vehicle voltage from the normally 14 or 15 volts to about 5 volts for supplying power to the microprocessor. The ignition module also includes a signal input for receiving a profile ignition pickup (PIP) signal from the Hall Effect stator assembly. The microprocessor is operative for comparing the spark output (SPOUT) signal with the profile ignition pickup (PIP) signal to determine a timing interval for switching ON and OFF the primary current within the ignition coil. The microprocessor can also be operative for determining when an engine threshold has been exceeded by processing engine operating parameters as determined by at least the spark output (SPOUT) signal and/or profile ignition pickup (PIP) signals generated to the ignition module. The microprocessor can also be operative for reducing the duty cycle or overall current or power after the temperature has been exceeded and when the engine RPM of the vehicle has dropped below a predetermined number.

In accordance with the present invention, a distributor for the vehicle includes a distributor base having a Hall Effect stator assembly mounted therein that generates a profile ignition pickup (PIP) signal indicative of crankshaft position and engine RPM to an electronic,control assembly (ECA) used on the vehicle. The ignition module receives a spark output (SPOUT) signal from an electronic control assembly (ECA) used on the vehicle. The ignition module includes a microprocessor for generating a control signal to an ignition coil and switching ON and OFF the primary current therein. A temperature sensing circuit is operative with the microprocessor for reducing the duty cycle or overall current or power as applied to the control signal from the ignition module to the ignition coil and reducing the generated heat when a temperature threshold for the ignition module has been exceeded.

In accordance with another aspect of the present invention, the ignition module is formed as a thick film integrated (TFI) module. It includes a housing adapted for mounting on a distributor. A thick film substrate is contained within the housing. A microprocessor is mounted on the thick film substrate and is operative for receiving at least a spark output (SPOUT) signal from an electronic control assembly (ECA) used on the vehicle. The TFI module generates a control signal to an ignition coil and switching ON and OFF the primary current therein. A temperature sensing circuit is operative with the microprocessor for reducing the duty cycle or overall current or power as applied to the control signal generated to the ignition coil to reduce the generated heat when a temperature threshold for the TFI module has been exceeded.

A method is also disclosed for operating an ignition system of a vehicle having an electronic engine control (EEC). The method includes the step of monitoring the temperature of an ignition module, such as a thick film integrated (TFI) module, which receives a spark output (SPOUT) signal from an electronic control assembly (ECA). A control signal is generated to an ignition coil for switching ON and OFF the primary current therein. The method further comprises the step of reducing the duty cycle or overall current or power as applied to the control signal from the ignition module to the ignition coil and reducing the generated heat when a temperature threshold for the ignition module has been exceeded. The method can also include the steps of monitoring the temperature in an ignition module mounted on a distributor having a Hall Effect stator assembly that generates a profile ignition pickup (PIP) signal indicative of crankshaft position and engine RPM to an electronic control assembly (ECA), which produces a spark output (SPOUT) signal to the ignition module. The ignition module includes a microprocessor operative for reducing the duty cycle as applied to control signals to the distributor.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The present invention advantageously provides an ignition system for a vehicle of the type having an ignition coil with primary and secondary windings for generating high-voltage signals to sparkplugs where an ignition module as a preferred thick film integrated (TFI) module has reduced heat generation, such as when operating at a low engine RPM, thus reducing the overall heat generated at the TFI module. In this ignition system, an electronic control assembly (ECA) generates a spark output (SPOUT) signal as known to those skilled in the art. The distributor includes a Hall Effect stator assembly mounted therein that generates a profile ignition pickup (PIP) signal indicative of crankshaft position and typically engine RPM to the electronic control assembly (ECA).

A thick film integrated (TFI) module receives a spark output (SPOUT) signal from the electronic control assembly (ECA). In accordance with the present invention, the TFI module includes a microprocessor that is programmed for the engine (such as four, six, eight cylinder engines) and generating a control signal to the ignition coil and switching ON and OFF the primary current therein. A temperature sensing circuit is operative with the microprocessor and operative for reducing the duty cycle or overall current or power as applied to the control signal from the TFI module to the ignition coil and reducing the generated heat when a temperature threshold for the TFI module has been exceeded. The present invention is especially applicable when the engine RPM is low, such as at idle speeds and below, and other low-speed engine operation where the amount of heat generation can be excessive.

Figure 1:
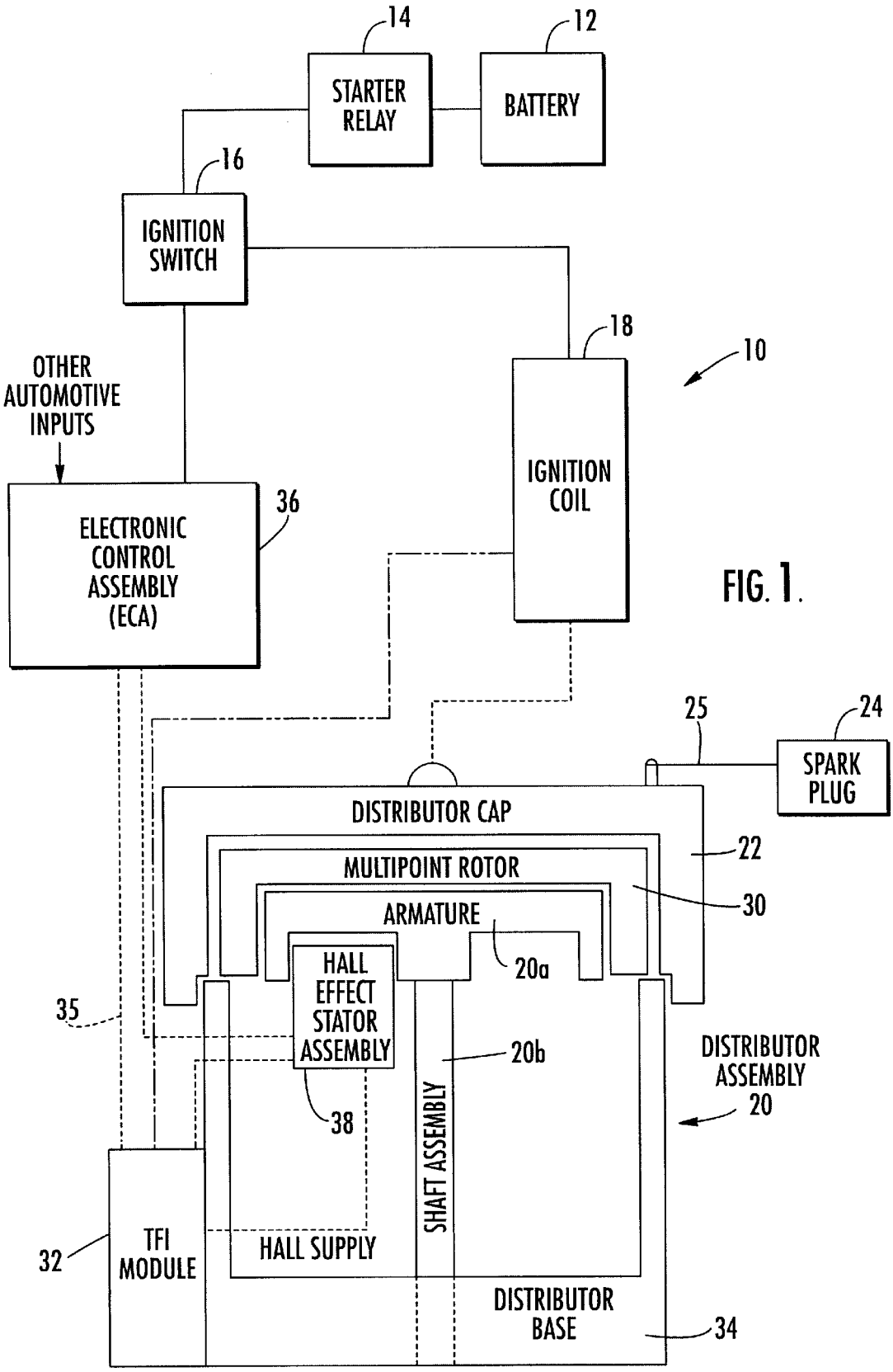
FIG. 1 is a block diagram of a typical thick film integrated (TFI) ignition system using an electronic control assembly (ECA) distributor with Hall Effect stator assembly and thick film integrated (TFI) module mounted on the distributor.

Referring now to FIG. 1, there is illustrated a block diagram of a typical thick film integrated (TFI)(type IV) electronic ignition system (EIS) 10, as one non-limiting example, used on thousands of different vehicles still in existence at the present time. A battery 12 provides the starting current and power at around 14 to about 15 volts to a starter relay 14. An ON/OFF/Start (ignition) switch 16 is operatively connected to an "E"-core ignition coil 18, which in turn, is operatively connected to a distributor assembly 20 via a distributor cap 22. The sparkplugs 24 receive high-voltage current via high tension sparkplug wires 25 as illustrated. The distributor assembly 20 includes a multi-point rotor 30 and an ignition module, which in the illustrated embodiment is a non-limiting thick film integrated (TFI) module 32. The TFI module 32 is mounted on a distributor base 34. The TFI module includes a module housing with a substrate therein and having lead wires 35 to the ignition coil 18 and an electronic control assembly (ECA) 36. The substrate can be adapted for surface mount technology. The distributor assembly 20 usually includes an armature 20*a* and shaft assembly 20*b* mounted in the distributor base 34 with possibly the addition of appropriate washers, snap rings, octane rods, grommets, bases, o-rings and drive gears as known to those skilled in the art.

Although the block diagram of FIG. 1 shows only one type of interconnection among the different ignition circuit elements, it should be understood that different ignition circuit elements can be connected in different combinations as suggested to those skilled in the art. The present invention is not necessarily limited to the illustrated components. This type of electronic ignition system 10 typically does not use centrifugal or vacuum advance mechanisms, but instead uses a Hall Effect stator assembly 38 (also known as the stator) that generates a profile ignition pickup (PIP) signal to the electronic control assembly 36. The profile ignition pickup (PIP) signal is processed by the electronic control assembly 36 and produces a spark output (SPOUT) signal that is transferred to the TFI module 32. ON and OFF current is switched by the TFI module 32 in the primary winding of the ignition coil 18. The interruption of the primary current in the ignition coil causes an open circuit, such that the collapsing magnetic field on the secondary coil produces a high voltage from about 20,000 to about 40,000 volts or higher. The high-voltage pulses are sent to the distributor 20, and its rotor 30 and distributor cap 22, which transfers the higher voltage to the sparkplugs using the high tension sparkplug wires for firing the sparkplugs.

Figure 2:
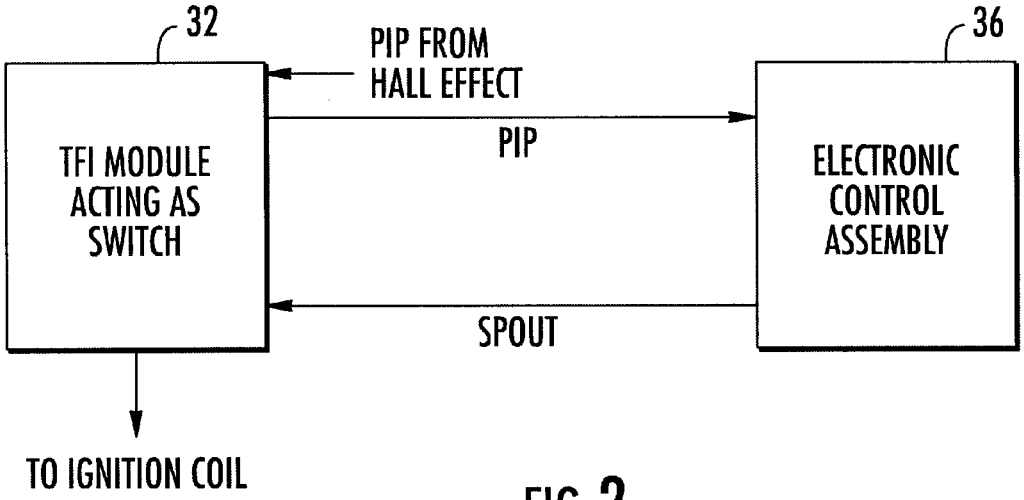
FIG. 2 is a block diagram showing the basic signals passing between the TFI module and the electronic control assembly.

As shown in the block diagram of FIG. 2, the profile ignition pickup (PIP) signal is one of the many inputs to the electronic control assembly 36. All sensor data and information provided by the different sensor inputs are used to create the spark output (SPOUT) signal that signifies electronically the engine operating condition. This signal is forwarded back to the TFI module 32, which is operative and similar to an internal electronic switch. The profile ignition pickup (PIP) signal is generated by the Hall Effect stator assembly and is indicative of crankshaft position and typically engine RPM. The TFI module 32 usually uses both of these signals for comparison and fires the ignition coil at proper timing intervals.

Figure 3:
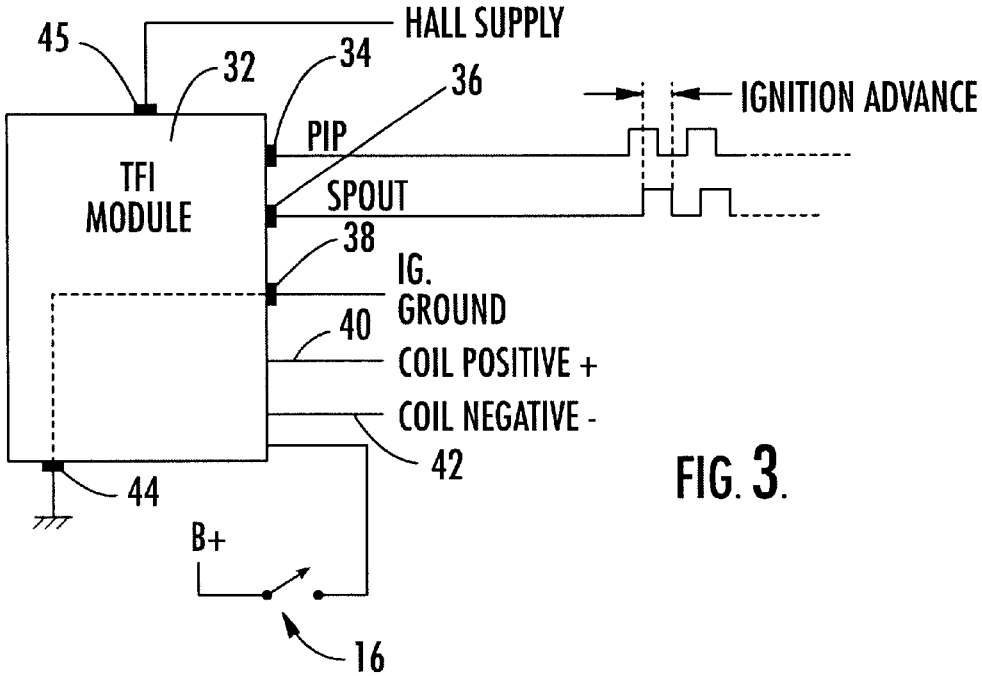
FIG. 3 is another block diagram showing various signals that pass to and from the TFI module and showing ignition advance relative to the profile ignition pickup (PIP) and spark output (SPOUT) signals.

FIG. 3 illustrates another block diagram of a TFI module 32 and shows the connectors 34, 36 for connecting to wires and receiving PIP and SPOUT signals that are input into the TFI module. A ground connection 38 can be connected to an insulated gate bipolar transistor (IGBT) as part of the TFI module 32. Positive and negative coil wires 40, 42 are connected to the ignition coil. A start signal is received from the ignition switch 16 and connects to positive battery voltage. The module 32 also includes a TFI ground point connection 44. The TFI module also provides a Hall supply voltage to the Hall Effect stator assembly via the Hall supply connection.45.

If the TFI module has power, is grounded, and receives a profile ignition pickup (PIP) signal from the Hall Effect stator assembly, there should be spark generation. The electronic control assembly (ECA) 36 usually would not control spark until engine RPM is above about 350 RPM. Even when the spark output (SPOUT) signal is eliminated from the overall electronic engine control, such as by failure, a spark for firing the plug would still occur, but the electronic engine control and more particularly, the electronic control assembly would log a fault code. Some TFI modules 32 used on manual transmission vehicles could have a "push start" feature allowing the vehicle to be "push started". It is also possible to have a fixed octane adjustment mechanism, such as a control rod operative with a distributor advancing mechanism as known to those skilled in the art.

As noted before, the profile ignition pickup (PIP) signal is generated by the Hall Effect stator assembly 38 to indicate crankshaft position and engine RPM. This PIP signal is fed to both the TFI module 32 and the electronic control assembly 36. The Hall Effect stator assembly 38 is usually formed as part of a rotary vane cup in a distributor and receives the battery voltage and includes a signal returned through a processor. The Hall Effect stator assembly may include a voltage regulator, a Hall voltage generator, a Darlington amplifier, Schmidt trigger and an open collector output stage integrated in a single monolithic silicon chip as part of a pickup assembly. A signal is produced when a ferrous material passes through an opening and any flux lines decrease. A Darlington amplifier receives a sine wave signal that is generated by the Hall generator as part of the Hall Effect and stator assembly. This signal is inverted by the Darlington amplifier, thus creating a high output when the signal is low, and a low output signal when the signal is high. A Schmidt trigger forms a square wave as a digital "high" signal to another switching transistor that is operatively connected to ground and in a loop back to the Hall voltage generator and regulator.

The Hall Effect stator assembly can also include a Hall element with leads which are spaced from a concentrator with a permanent magnet. An output to the Darlington amplifier is high when a formed window on the armature allows the magnetic field to reach the Hall device. This corresponds to a switched ON condition. A signal is low to the Darlington amplifier in a switched OFF condition when a tab shunts the magnetic field away from the Hall device. Thus, any windows or openings in a gap between the Hall device and permanent magnet completes a magnetic path from the magnet, through the Hall device and back to the magnet. Thus, the Hall Effect stator assembly does not transmit a signal. When a tab enters the gap as known to those skilled in the art, an armature cuts the magnetic path and voltage drops. The switch is operative and signal is sent and switched ON and OFF as the armature rotates, opening and closing the magnetic path. This signal can be used by the electronic control assembly to determine the position of the crankshaft and the engine RPM and used by the TFI module to ensure engine operation when any SPOUT signal is terminated through error or damage.

It is also known to have electronic engine controls that can use a signature profile ignition pickup signal when one tab is more narrow than other tabs. This will provide a different signal to fuel injectors, and is useful for sequential electronic fuel injection (SEFI)systems where an injector is timed to coincide with the intake valve opening.

It is also possible to use an ignition diagnostic monitor (IDM) circuit as one of the inputs to the electronic control assembly from a negative terminal of an ignition coil. This can be used as a comparison reference and enable the electronic control assembly to determine whether any intermittent faults occur in the ignition primary circuit. When the electronic control assembly receives a profile ignition pickup (PIP) signal and transmits the spark output (SPOUT) signal to the TFI module, a signal can be observed by the IDM terminal at the electronic control assembly. This can allow greater diagnostic monitoring of the ignition coil signal.

Figure 4:
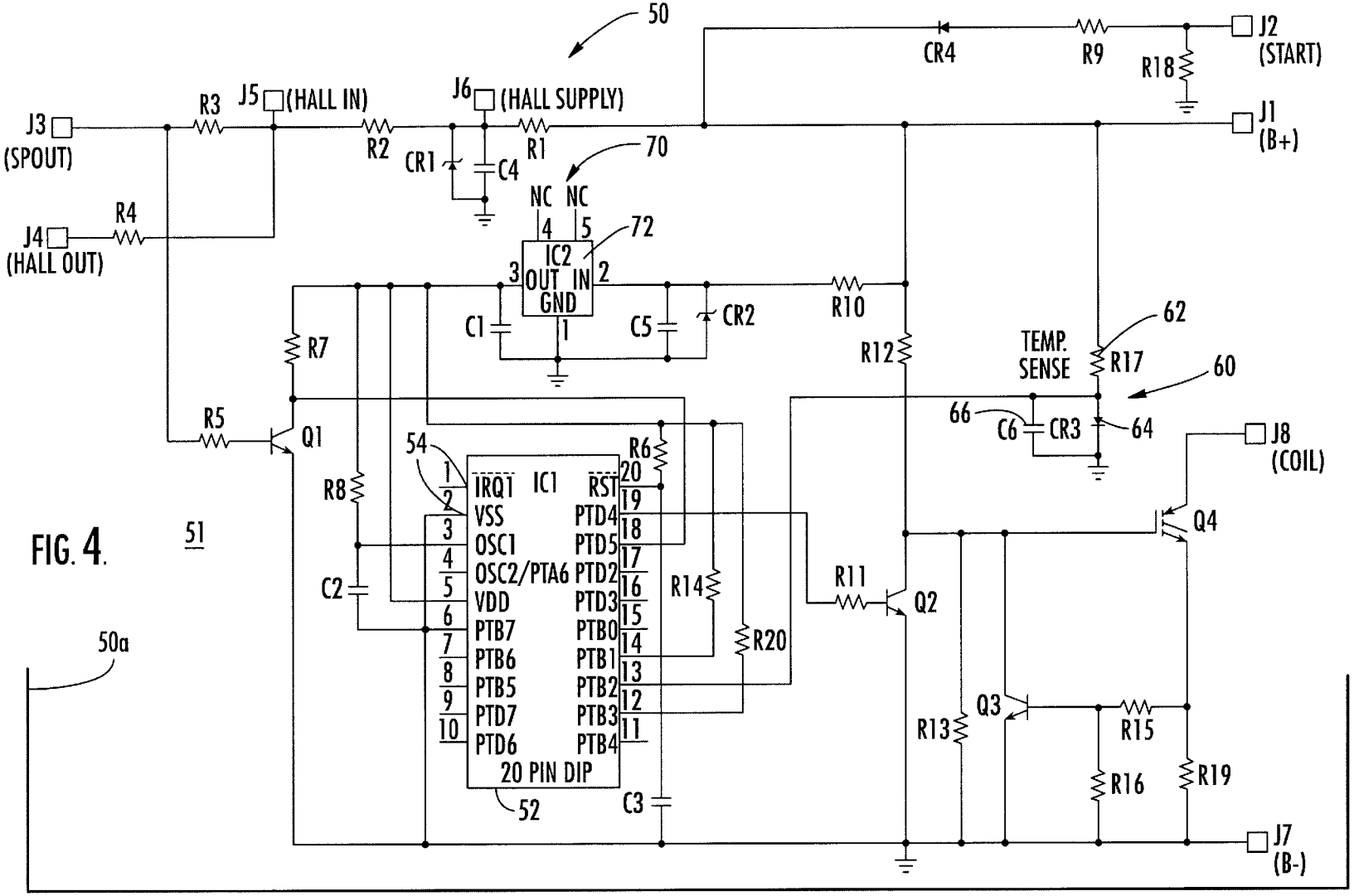
FIG. 4 is a schematic circuit diagram of one example of a circuit used for the thick film integrated (TFI) module in accordance with the present invention, and including a microprocessor and temperature sensing circuit operative with the microprocessor for reducing duty cycle or overall current or power as applied to the control signal from the TFI module to the ignition coil and reducing generated heat when a temperature threshold for the TFI module has been exceeded.

Referring now to FIG. 4, there is illustrated a schematic circuit diagram of one example of the types of circuit components that can be used in the thick film integrated (TFI) module 50 of the present invention. The TFI module 50 includes a module housing 50*a* for mounting on a distributor base. The TFI module 50 includes appropriate connector terminals for all SPOUT, PIP and power connections. Appropriate analog-to-digital conversion circuits are included as part of the microprocessor circuit. The TFI module 50 includes a thick film integrated circuit substrate 51 having surface mounted thereon a microprocessor 52, illustrated as a 20-pin, dual in-line package (DIP). Although a 20-pin microprocessor with trade designation MC68HRC908JK1 is illustrated, an 8-pin or other microprocessor could be used as long as the appropriate inputs, temperature sensing circuit, voltage reduction circuit and other circuits for providing a control signal to the ignition coil with a reduced duty cycle or overall current or power. Other electronic components can be surface mounted thereon. The microprocessor receives a spark output (SPOUT) signal and profile ignition pickup (PIP) signal. The microprocessor will be programmed for operation based on vehicle and engine type, such as four, six or eight cylinder engines. In the illustrated embodiment, the microprocessor includes various signal pins 54 (labeled pins 1–20) and include an interrupt (IRQ1) pin, voltage and current supply (VSS and VDD) pins, oscillator pins (OSC1 and OSC2/PTA6), various PTD and PTB pins, and an RST pin. The circuit includes a J1 terminal that connects to a battery B+ power terminal and a J2 terminal that connects to the starter switch 16 and/or relay 14 (FIG. 1) depending on the current design chosen by those skilled in the art.

The J3 terminal receives a spark output (SPOUT) signal from the electronic control assembly 26. The J5 terminal receives the profile ignition pickup (PIP) signal from the Hall Effect stator assembly 38 and transfers it into a "Hall Out terminal, J4. A Hall supply terminal, J6, connects to the Hall connection/power. Negative battery voltage (B−) is provided at terminal J7, which preferably connects to ground as illustrated and connects to the negative connection terminal of the ignition coil. The J8 coil terminal connects to the other coil connection.

For purposes of description, the overall function of this circuit is first described followed by more-detailed description of circuit components and interconnections. As noted before, an 8-pin microprocessor can accomplish the function as described, but would have different circuit connections as would be understood by those skilled in the art.

The TFI module 50 generates a control signal to the ignition coil and switches ON and OFF the primary current therein. A temperature sensing circuit 60 is operative with the microprocessor 52 and reduces the duty cycle or average or overall current or power as applied to the control signal from the TFI module to the ignition coil and reduces the heat generated by the TFI module when the temperature threshold for the TFI module has been exceeded. The microprocessor 52 is operative in one aspect of the present invention for reducing the duty cycle from about 5% to about 15%. The temperature sensing circuit 60 in the illustrated embodiment as a non-limiting example includes a temperature sensing resistor 62 and a reference diode 64 that is connected in parallel with a capacitor 66 to establish a temperature control signal back to the microprocessor 52. This signal is preferably linear as temperature changes in the thick film integrated (TFI) module.

As illustrated, a voltage reduction circuit 70 is operatively connected to the starter terminal J2 and reduces vehicle voltage from about 14 or 15 volts to about 5 volts for supplying the proper voltage to the microprocessor 52. The voltage reduction circuit 70 includes an integrated circuit 72 as a translator circuit that is operatively connected to the starter terminal J2 and Zener diode CR2 in parallel with capacitor C1 and C5, as illustrated.

In the present invention, the microprocessor 52 is operative for comparing the spark output (SPOUT) signal with the profile ignition pickup (PIP) signal to determine a timing interval for switching ON and OFF the primary current within the ignition coil. The microprocessor 52 is also operative for determining when an engine threshold has been exceeded by processing engine operating parameters as determined by at least spark output (SPOUT) signals and/or profile ignition pickup (PIP) signals generated to the TFI module. The microprocessor 52 can be operative for reducing the duty or overall current or power cycle after the temperature threshold has been exceeded and when the engine RPM of the vehicle has dropped below a predetermined number, such as below idle speed, which could correspond to about 330 Hz operation, or even values as high as 5000 RPM or lower values such as about 1500 to about 2000 RPM. Typically, the microprocessor is programmed to cut back at idle speeds and below. Although the temperature threshold can vary, depending on circuit conditions, use of any heat sinks in the TFI module and associated factors, a typical threshold could vary from about 80 degrees to about 90 degrees Centigrade.

As illustrated, the output from the microprocessor at PTD4 (pin 19) passes through a resistor R11 that provides the biased signal to the base of transistor Q2. The collector output is passed as an input for module output transistor Q4, which provides the output to the ignition coil connected at terminals J7 and J8. Module output transistor Q4 can be selected from different types of transistors, including in some examples an insulated gate bipolar transistor. The microprocessor allows greater signal control as compared to prior art devices, allowing inexpensive components, as compared to prior art devices, including a module output transistor Q4. Other resistors as illustrated provide appropriate voltage divider and other circuit resistances as necessary for the illustrated circuit operation. Transistor Q3 acts also to aid operation of module output transistor Q4.

The Hall supply terminal J6 is operative with the Hall Effect stator assembly for power supply and includes appropriate Zener diode CR1 and capacitor C4 in a parallel circuit combination that is operative with resistors R1 and R2. Transistor Q1 is operative for amplifying the received SPOUT and PIP signals into the microprocessor at PTD5 (pin 18). Other capacitors and resistors are illustrated connected within the circuit for complete circuit operation and have values chosen for optimum circuit operation.

The temperature sensing circuit 60 establishes the temperature control signal to the microprocessor and is linear with the temperature change in the thick film integrated (TFI) module of the present invention. When a predetermined threshold is reached, such as 85 degrees C. as a non-limiting example, the duty cycle or overall power or current relative to the control signal to the ignition coil is reduced, for example, by about 5% to about 15%, and in another example, by about 10% as non-limiting examples, for reducing heat generation at the TFI module.

Figure 5:
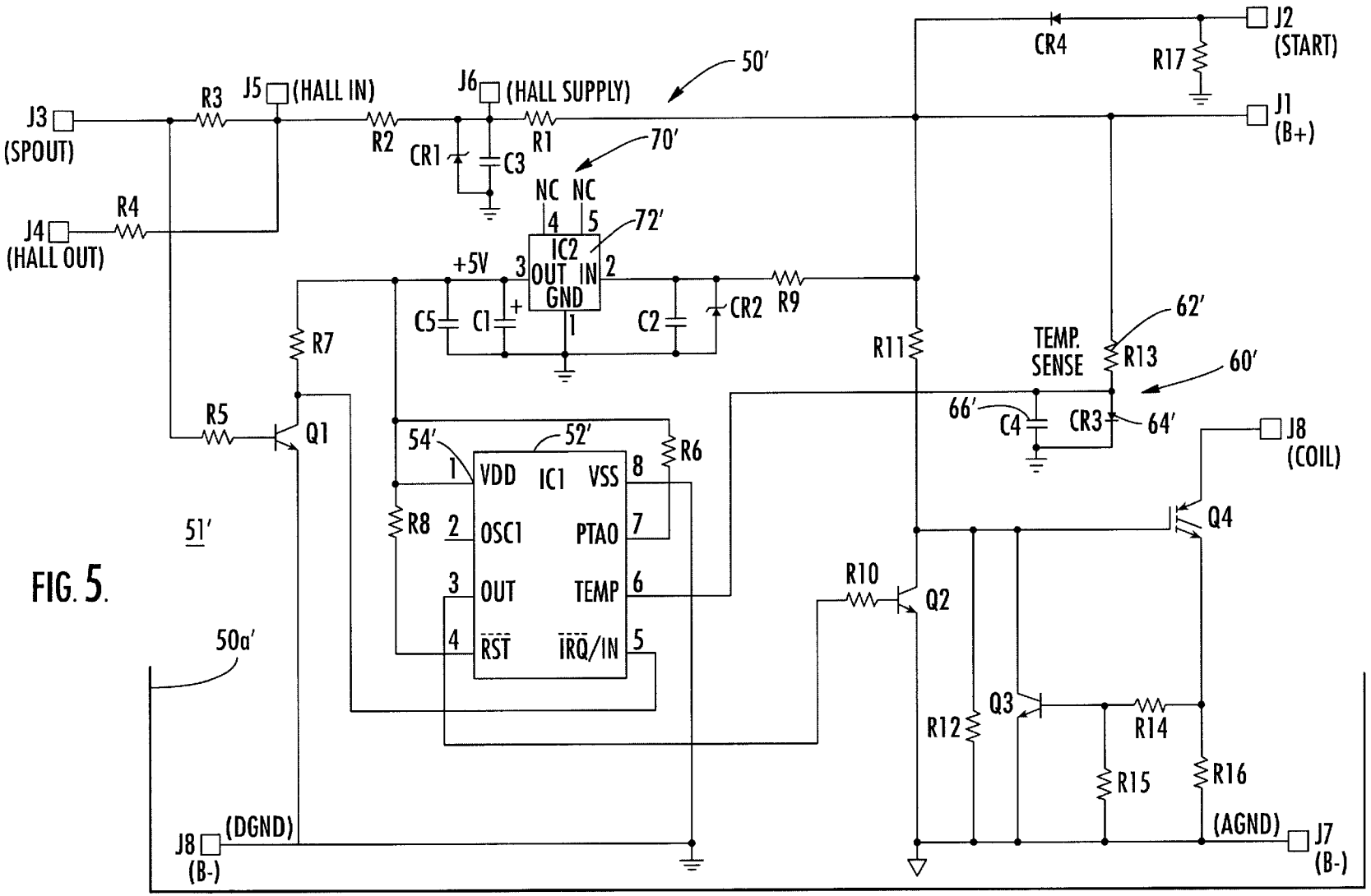
FIG. 5 is another schematic circuit diagram similar to that shown in FIG. 4, but using an 8-pin microprocessor.

Referring now to FIG. 5, there is illustrated another embodiment of the present invention for the TFI module 50' that uses an 8-pin microprocessor under the trade designation MC68HC908QT2. The same reference numerals as used in FIG. 4 are used in FIG. 5 (with prime notation) relative to the circuit components. The function of the circuit shown in FIG. 5 is similar to the function of the circuit shown in FIG. 4. The circuit of FIG. 5 also includes the translator circuit 70' and the temperature sensing circuit 60'. The circuit also uses transistors Q1–Q4 as in FIG. 4. The microprocessor 52' includes eight signal pins 54', including a VDD pin 1, OSC pin 2, an OUT pin 3, an RST pin 4, a VSS pin 8, a PTAO pin 7, a temperature (TEMP) pin 6 that is operative with the temperature sensing circuit 60', and a signal-in interrupt (IRQ/IN) pin 5 that receives the signal from the transistor Q1 that is fed by SPOUT and HALL J3 and J4 terminals. The connections J1–J8 are similar as in FIG. 4. The translation circuit 70' includes three capacitors C1, C2 and C5 as compared to the two capacitors of FIG. 4, i.e., capacitors C1 and C5. The Zener diode CR2 is a 10-volt Zener diode as in FIG. 4. Other circuit functions operate similarly.

Although the system and method of the present invention is illustrated for use with an electronic control assembly and TFI module, it should be understood that the microprocessor and associated temperature sensing circuit and translator circuit can be used with other automotive devices where the duty cycle is reduced as applied to control signals from a module to the automotive device, such as an alternator or the ignition coil as shown in the drawing figures and explained above. This would reduce the heat generated by the devices when the temperature threshold forward device has been exceeded.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An ignition system for a vehicle comprising:

an ignition coil having primary and secondary windings for generating high voltage signals to spark plugs;

an electronic control assembly (ECA) that generates a spark output (SPOUT) signal;

a distributor having a Hall Effect stator assembly mounted therein that generates a profile ignition pickup (PIP) signal indicative of crankshaft position and engine RPM to said electronic control assembly (ECA); and an ignition module for receiving the spark output (SPOUT) signal from the electronic control assembly (ECA), said ignition module including a microprocessor for generating a control signal to an ignition coil and switching ON and OFF the primary current therein and a temperature sensing circuit operative with the microprocessor for reducing the duty cycle as applied to the control signal from the ignition module to the ignition coil and reducing the heat generated when a temperature threshold for the ignition module has been exceeded.

2. An ignition system according to claim 1 and further comprising an armature and shaft assembly mounted within the distributor, wherein said ignition module is mounted on the distributor.

3. An ignition system according to claim 1 wherein the microprocessor is operative for reducing the duty cycle from about 5% to about 15%.

4. An ignition system according to claim 1 wherein the temperature sensing circuit comprises a temperature sensing resistor and reference diode for establishing a temperature control signal to the microprocessor that is linear with temperature change in the ignition module.

5. An ignition system according to claim 1 wherein the ignition module further comprises a circuit for reducing vehicle voltage that is about 14 to about 15 volts to about 5 volts for supplying power to the microprocessor.

6. An ignition system according to claim 1 wherein the ignition module further comprises a signal input for receiving a profile ignition pickup (PIP) signal from the Hall Effect stator assembly.

7. An ignition system according to claim 6 wherein the microprocessor is operative for comparing the spark output (SPOUT) signal with the profile ignition pickup (PIP) signal to determine a timing interval for switching ON and OFF the primary current within the ignition coil.

8. An ignition system according to claim 6 wherein the microprocessor within the ignition module is operative for determining when an engine threshold has been exceeded by processing engine operating parameters as determined by at least the spark output (SPOUT) signals and/or profile ignition pickup (PIP) signals generated to the ignition module.

9. An ignition system according to claim 1 wherein the microprocessor within the ignition module is operative for reducing the duty cycle after the temperature threshold has been exceeded and when the engine RPM of the vehicle has dropped below a predetermined number.

10. A distributor for a vehicle comprising:

a distributor base having a Hall Effect stator assembly mounted therein and operative for generating a profile ignition pickup (PIP) signal indicative of crankshaft position and engine RPM to an electronic control assembly (ECA) used on the vehicle; and an ignition module that receives a spark output (SPOUT) signal from an electronic control assembly (ECA) used on the vehicle, said ignition module including a microprocessor for generating a control signal to an ignition coil and switching ON and OFF the primary current therein, and a temperature sensing circuit operative with the microprocessor for reducing the duty cycle as applied to the control signal from the ignition module to the ignition coil for reducing the generated heat by the TFI module when a temperature threshold for the ignition module has been exceeded.

11. A distributor according to claim 10 and further comprising an armature and shaft assembly mounted within the distributor base, wherein said ignition module is mounted on the distributor base.

12. A distributor according to claim 10 wherein the microprocessor is operative for reducing the duty cycle from about 5% to about 15%.

13. A distributor according to claim 10 wherein the temperature sensing circuit comprises a temperature sensing resistor and reference diode for establishing a temperature control signal to the microprocessor that is linear with temperature change in the ignition module.

14. A distributor according to claim 10 wherein the ignition module further comprises a circuit for reducing vehicle voltage that is about 14 to about 15 volts to about 5 volts for supplying power to the microprocessor.

15. A distributor according to claim 10 wherein the ignition module further comprises a signal input for receiving a profile ignition pickup (PIP) signal from the Hall Effect stator assembly.

16. A distributor according to claim 15 wherein the microprocessor is operative for comparing the spark output (SPOUT) signal with the profile ignition pickup (PIP) signal within the ignition module to determine a timing interval for switching ON and OFF the primary current within the ignition coil.

17. A distributor according to claim 16 wherein the microprocessor within the ignition module is operative for determining when an engine threshold has been exceeded by processing engine operating parameters as determined by at least the spark output (SPOUT) signals and/or profile ignition pickup (PIP) signals generated to the ignition module.

18. A distributor according to claim 10 wherein the microprocessor within the ignition module is operative for reducing the duty cycle after the temperature threshold has been exceeded and when the engine RPM of the vehicle has dropped below a predetermined number.

19. A method of operating an ignition system of a vehicle having an electronic engine control (EEC) comprising the steps of:

monitoring the temperature in an ignition module mounted on a distributor having a Hall Effect stator assembly that generates a profile ignition pickup (PIP) signal indicative of crankshaft position and engine RPM to the electronic control assembly (ECA), which produces a spark output (SPOUT) signal to the ignition module, wherein the ignition module includes a microprocessor for generating a control signal to the ignition coil and switching ON and OFF the primary current therein; and reducing the duty cycle as applied to the control signal from the ignition module to the ignition coil and reducing the heat generated by the ignition module when a temperature threshold for the ignition TFI module has been exceeded.

20. A method according to claim 19 and further comprising the step of reducing the duty cycle from about 5% to about 15%.

21. A method according to claim 19 and further comprising the step of transmitting the profile ignition pickup (PIP) signal to the ignition module.

22. A method according to claim 21 and further comprising the step of comparing the spark output (SPOUT) signal with the profile ignition pickup (PIP) signal within the ignition module to determine a timing interval for switching ON and OFF the primary current within the ignition coil.

23. A method,according to claim 21 and further comprising the step of determining when the temperature threshold has been exceeded by processing engine operating parameters as determined by at least the spark output (SPOUT) and/or profile ignition pickup (PIP) signals generated to the ignition module.

24. A method according to claim 19 and further comprising the step of reducing the duty cycle after the temperature threshold has been exceeded and when the engine RPM of the vehicle has dropped below a predetermined number.

25. A method according to claim 19 and further comprising the step of sensing temperature within the ignition module for determining when the temperature threshold for the ignition module has been exceeded.

26. A method according to claim 19 and further comprising the step of sensing current within a temperature sensing circuit for determining when if the temperature threshold has been exceeded.

27. A method according to claim 26 wherein the temperature sensing circuit comprises a temperature sensing resistor.

28. A method according to claim 27 and further comprising the step of rectifying a signal that passes through the temperature sensing resistor using a reference diode for establishing a temperature control signal to the microprocessor that is linear with temperature change in the ignition module.

* * * * *